US007946728B2

(12) United States Patent
Tang et al.

(10) Patent No.: US 7,946,728 B2
(45) Date of Patent: May 24, 2011

(54) COMBINATION SIGNAL RECEIVING DEVICE

(75) Inventors: Chiang-Kuo Tang, Taipei Hsien (TW); Qian-Kun Han, Shenzhen (CN); Gao-Hui Tang, Shenzhen (CN); Qiu-Chun Zhao, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 217 days.

(21) Appl. No.: 12/426,934

(22) Filed: Apr. 20, 2009

(65) Prior Publication Data

US 2010/0046228 A1 Feb. 25, 2010

(30) Foreign Application Priority Data

Aug. 22, 2008 (CN) ..... 2008 1 0304153

(51) Int. Cl.
*F21V 33/00* (2006.01)

(52) U.S. Cl. ..... 362/253; 362/800

(58) Field of Classification Search ..... 362/800, 362/802, 253, 234
See application file for complete search history.

(56) References Cited

U.S. PATENT DOCUMENTS 7,419,277 B2 * 9/2008 Von Ronn et al. ..... 362/194
2001/0038339 A1 * 11/2001 McKenzie et al. ..... 340/825.36

* cited by examiner

*Primary Examiner* — Laura Tso
(74) *Attorney, Agent, or Firm* — Zhigang Ma

(57) ABSTRACT

A combination signal receiving device includes a printed circuit board, a light source, a light cover, a receiving cover, and at least one signal receiver. The light source is mounted on the printed circuit board. The light cover is lighttight except a light transmissive logo. The light cover covers the light source. The receiving cover surrounds the light cover. The signal receiver is mounted on the printed circuit board beneath the receiving cover, configured for receiving outside signal passing through the receiving cover. Light emitted by the light source is incapable of reaching the signal receiver. The combination signal receiving device does not negatively influence the appearance of an electronic apparatus.

8 Claims, 3 Drawing Sheets

COMBINATION SIGNAL RECEIVING DEVICE

BACKGROUND

1. Technical Field

The present disclosure relates to a signal receiving device used in an electronic apparatus.

2. Description of Related Art

Appearance of consumer electronic apparatuses, such as digital photo frames and mobile phones, is important for attracting consumers. Yet, as electronic apparatuses have more and more components for performing more and more functions, the appearance of the electronic apparatuses may be influenced. If the electronic apparatuses have signal receiving devices for receiving outside signals, such as lights or infrared signals, the appearance of the electronic apparatuses may be negatively influenced as the signal receiving devices should be accessible from outside by signals.

What is needed is a signal receiving device which doesn't negatively influence the appearance of electronic apparatuses.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
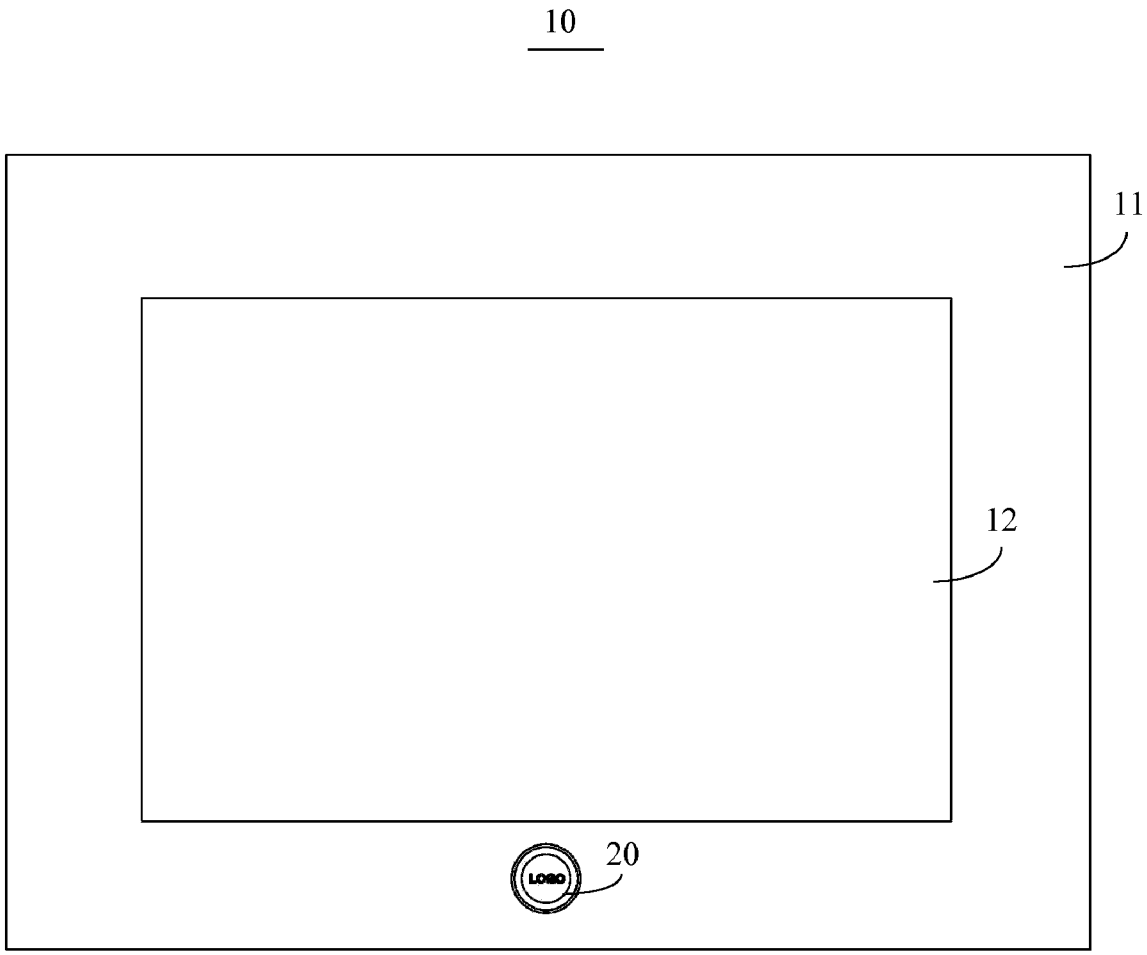
FIG. 1 is a front view of an electronic apparatus, which includes a combination signal receiving device, according to an exemplary embodiment.

Referring to FIG. 1, an electronic apparatus 10 is disclosed. The electronic apparatus 10 includes a housing 11. The housing 11 is configured for receiving a display panel 12 and a combination signal receiving device 20.

Figure 2:
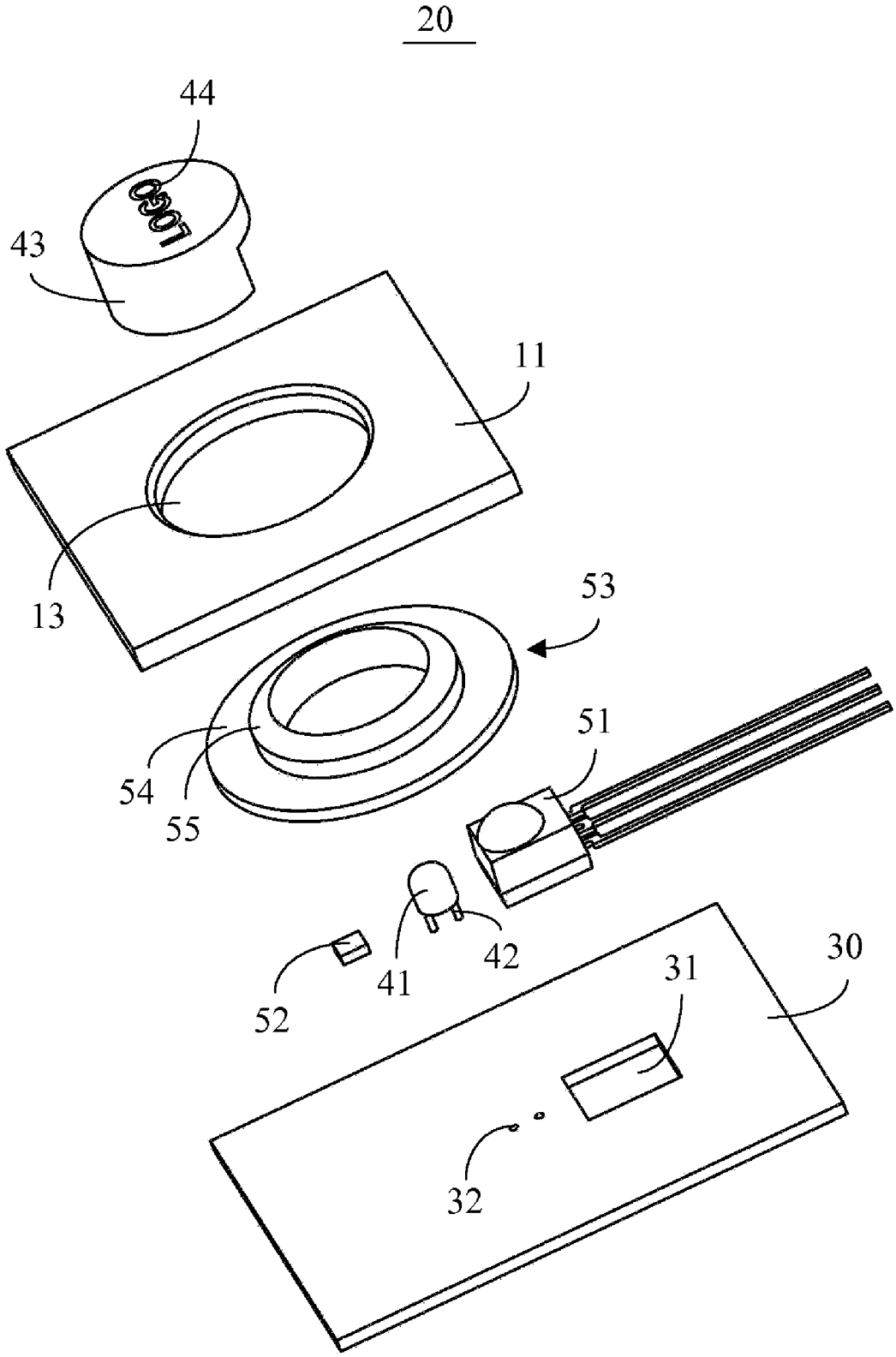
FIG. 2 is an exploded view of the combination signal receiving device of FIG. 1.
Figure 3:
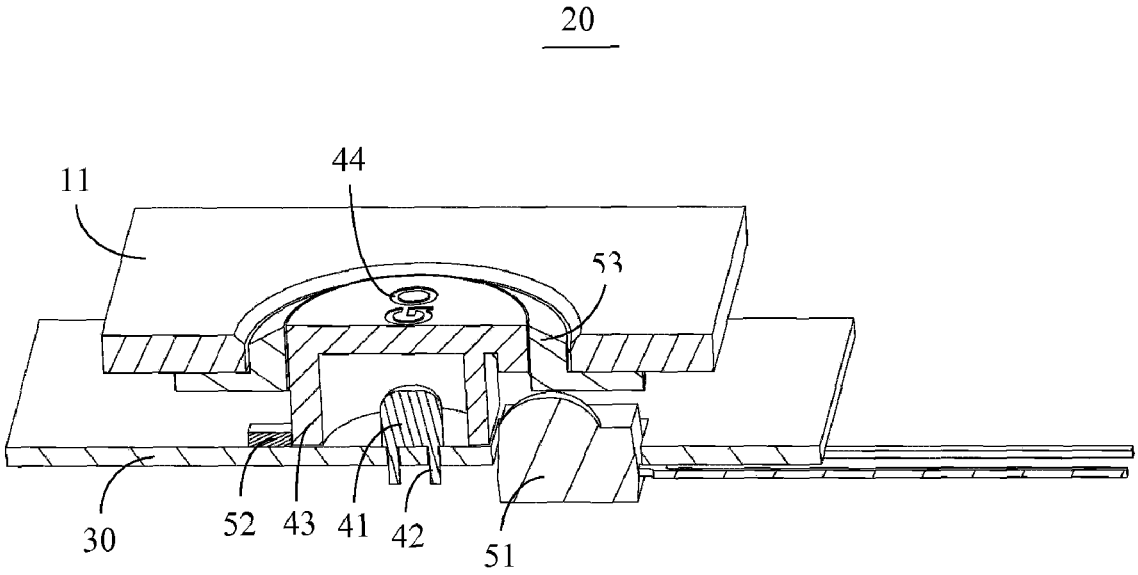
FIG. 3 is a schematic, isometric and cutaway view of the combination signal receiving device of FIG. 1, with parts of the combination signal receiving device removed.

Referring to FIGS. 2 and 3, the signal receiving device 20 includes a printed circuit board (PCB) 30, a light source 41, signal receivers 51, 52, a receiving cover 53, and a light cover 43.

In this embodiment, the light source 41 is a light emitting diode (LED) that includes two pins 42. The pins 42 are inserted into holes 31 defined in the PCB 30, thus to mount the LED 41 on the PCB 30. The light cover 43 is barrel-shaped with an open end and a closed end. A logo 44 is formed on the closed end of the light cover 43. Light tight coating is painted on the surface of the light cover 43 without the logo 44. The light cover 43 is mounted on the PCB 30 and covers the LED 41, thus light emitted by the LED 41 can only transmit through the area of the logo 44.

In this embodiment, the signal receiver 51 is an infrared signal receiver, and the signal receiver 52 is a light signal receiver. The signal receivers 51, 52 are mounted on the PCB 30 and around the light cover 43. The light emitted by the LED 41 cannot reach the signal receivers 51, 52 because of the light cover 43.

The receiving cover 53 is made up of light transmissive material. The receiving cover 53 is ring-shaped, and includes a horizontal part 54 and a vertical part 55. The vertical part 55 is extended upwardly from the inner edge of the horizontal part 54. An inner diameter of the receiving cover 53 is equal or slightly greater than an outer diameter of the light cover 43. The receiving cover 53 is fit over the light cover 43 and is positioned above the signal receivers 51, 52.

The housing 11 of the electronic apparatus 10 defines a receiving hole 13. A top of the combination signal receiving device 20 includes the vertical part 55 of the receiving cover 53 and the closed end of the light cover 43. The top of the combination signal receiving device 20 is exposed to the outer surface of the housing 11 through the receiving hole 13.

The appearance of the combination signal receiving device 20 is a lighted logo which decorates the electronic apparatus 10. The signal receiver 51, 52 can receive and deal with outside infrared signals and light signals passing through the receiving cover 53.

Moreover, it is to be understood that the invention may be embodied in other forms without departing from the spirit thereof. Thus, the present examples and embodiments are to be considered in all respects as illustrative and not restrictive, and the invention is not to be limited to the details given herein.

What is claimed is:

1. A combination signal receiving device comprising:

a printed circuit board;

a light source mounted on the printed circuit board;

a light cover covering the light source, wherein the light cover is light tight except a light transmissive logo;

a receiving cover around the light cover; and at least one signal receiver mounted on the printed circuit board beneath the receiving cover, configured for receiving outside signal passing through the receiving cover; wherein light emitted by the light source is incapable of reaching the at least one signal receiver.

2. The combination signal receiving device of claim 1, wherein the receiving cover is light transmissive.

3. The combination signal receiving device of claim 1, wherein the at least one signal receiver comprises an infrared signal receiver.

4. The combination signal receiving device of claim 1, wherein the at least one signal receiver comprises a light signal receiver.

5. The combination signal receiving device of claim 1, wherein the light cover is barrel-shaped.

6. The combination signal receiving device of claim 1, wherein the receiving cover is ring-shaped.

7. The combination signal receiving device of claim 6, wherein the receiving cover comprises a horizontal part and a vertical part extended upwardly from an inner edge of the horizontal part.

8. The combination signal receiving device of claim 6, wherein the at least one signal receiver comprises a light signal receiver and an infrared signal receiver.

* * * * *